US010046365B2

(12) United States Patent
McKeown et al.

(10) Patent No.: US 10,046,365 B2
(45) Date of Patent: Aug. 14, 2018

(54) MULTI-DECK SCREENING ASSEMBLY

(71) Applicant: CDE Global Limited, Cookstown, County Tyrone (GB)

(72) Inventors: Christopher McKeown, Magherafelt (GB); Kevin Vallelly, Maghera (GB)

(73) Assignee: CDE Global Limited, Cookstown, County Tyrone (GB)

( * ) Notice: Subject to any disclaimer, the term of this patent is extended or adjusted under 35 U.S.C. 154(b) by 0 days.

(21) Appl. No.: 15/610,180

(22) Filed: May 31, 2017

(65) Prior Publication Data

US 2017/0348732 A1 Dec. 7, 2017

(30) Foreign Application Priority Data

Jun. 1, 2016 (GB) ..... 1609608.3

(51) Int. Cl.
*B07B 1/28* (2006.01)
*B07B 1/46* (2006.01)

(52) U.S. Cl.
CPC ..... *B07B 1/4645* (2013.01); *B07B 1/286* (2013.01); *B07B 2201/04* (2013.01)

(58) Field of Classification Search
CPC .... B07B 1/4645; B07B 1/286; B07B 2201/04
USPC ..... 209/233, 311, 315, 659
See application file for complete search history.

(56) References Cited

U.S. PATENT DOCUMENTS 3,077,266 A 2/1963 Plumb
8,556,083 B2 * 10/2013 Burnett ..... B01D 33/0376 209/315
8,869,986 B2 * 10/2014 Bailey ..... B07B 13/16 209/10

(Continued)

FOREIGN PATENT DOCUMENTS

EP 2910313 8/2015
GB 2515489 12/2014
JP H1110641 1/1999

OTHER PUBLICATIONS

UK Search Report dated Dec. 6, 2016 for corresponding UK Application No. GB1609608.3.

(Continued)

*Primary Examiner* — Terrell H Matthews
(74) *Attorney, Agent, or Firm* — Gardner, Linn, Burkhart & Ondersma LLP

(57) ABSTRACT

A multi-deck screening assembly includes upper and lower screen decks, each having first and second deck sections. The upper deck's first deck section has first-size grading apertures, and its second deck section is downstream of the first deck section with second-size grading apertures larger than the first-size apertures. The lower deck's first section has third-size grading apertures and its second section is downstream of its first section with fourth-size grading apertures larger than the third-size apertures. A gap between the lower deck's first and second sections allows oversize material from the lower deck's first section to pass through to a first collection region. A diverter is positioned between (Continued)

the upper and lower decks and over the gap, whereby material from the upper deck collected on the diverter passes onto the lower deck's second section, thereby preventing undersize material that passes through the upper deck from passing directly through the gap.

16 Claims, 3 Drawing Sheets

(56) References Cited

U.S. PATENT DOCUMENTS

| | | | | |
|---|---|---|---|---|
| 9,409,208 | B2 * | 8/2016 | Convery | B07B 1/286 |
| 9,776,214 | B2 * | 10/2017 | Vallelly | B07B 1/005 |
| 2003/0173257 | A1 * | 9/2003 | Olsen | B07B 1/46 209/1 |
| 2014/0061102 | A1 * | 3/2014 | Sauser | B07B 1/28 209/315 |

OTHER PUBLICATIONS

European Search Report dated Oct. 23, 2017 for corresponding UK Application No. GB1609608.3.

* cited by examiner

MULTI-DECK SCREENING ASSEMBLY

FIELD OF THE INVENTION

The present invention relates to screen assemblies used to sort, grade or classify particulate material such as sand and aggregate.

BACKGROUND OF THE INVENTION

Vibrating screens are commonly used to sort, grade or classify particulate material, such as sand and aggregate, either in the wet or dry state.

A typical vibrating screen comprises a frame, typically defined by a pair of substantially parallel side walls interconnected by transversely extending bridging members, upon which is mounted a polyurethane screen deck having small openings or slots for water and/or undersize particles to pass through.

The frame is mounted on a chassis via resilient mountings and the frame, and thus the screen, is typically vibrated by means of a pair of counter rotating rotors defining eccentric masses driven by one or more drive motors, to impart circular or reciprocating vibratory motion to the screen. The vibration imparting rotors may be arranged to impart a resultant motion to the material from an upstream to a downstream end of the or each screen deck and/or the screen deck may be arranged at a predetermined slope and material to be graded is delivered onto an upper or upstream end of the screen, typically entrained in a flow of water, particularly if the material is also being washed. The screen is vibrated at high frequency to convey the material over the screen deck and to cause undersize material (and water if present) to pass through the openings in the screen deck, oversize material being discharged from a downstream end of the deck onto a stockpile conveyor or into a collection bay or hopper.

It is known to provide a multi-deck screening assembly to produce a number of different grades of product. A plurality of screen decks, typically two or three decks, are typically arranged one above the other, and generally parallel to each other, typically each with a downward slope from an upper receiving end to a lower discharge end at which over-sized material (relative to the screen deck concerned) can be discharged. Material of a size in excess of the size of the screening apertures of each screen deck is discharged under gravity from the lower or downstream end of the respective deck onto a respective stockpile conveyor, whereas undersized material able to pass downwardly through the screening apertures of the respective screen deck falls under gravity onto the deck below, where the further screening action takes place, or into a collection region or sump in the case of the lowest deck.

Where four different grades are required it is normally necessary to use a triple deck screen assembly, wherein a first oversize grade is provided from a downstream end of the uppermost deck, a second grade is provided from a downstream end of the intermediate deck, a third grade is provided from a downstream end of the lowest deck while a fourth undersize grade is passes through the lowest deck to be collected in a sump therebelow.

A problem with existing triple deck screen assemblies is how to arrange each of the screen decks within the dimensional constraints of the chassis, particularly in relation to the height of the assembly, while enabling over-sized material from each deck to be delivered onto a respective stockpile conveyor.

SUMMARY OF THE INVENTION

According to an aspect of the present invention there is provided a multi-deck screening assembly comprising a plurality of vertically stacked screen decks, each screen deck having a plurality of grading apertures formed therethrough whereby under-sized material may pass through the apertures while over-sized material passes over a discharge end of each screen deck, the plurality of screen decks being mounted on a common frame, the frame being mounted on a chassis via resilient mounts and being provided with vibration generating means for imparting vibration to the screen decks, the plurality of screen decks comprising an upper deck and a lower deck mounted below the upper deck for receiving under-sized material from the upper deck, wherein the upper deck comprises a first deck section having grading apertures of a first size and a second deck section downstream of the first deck section, the second deck section having grading apertures of a second size, the second size being larger than the first size, and wherein the lower deck comprises a first deck section having grading apertures of a third size and a second deck section, downstream of the first deck section of the lower deck, the second deck section of the lower deck having grading apertures of a fourth size, the fourth size being larger than the third size, a gap being defined between the first and second deck sections of the lower deck whereby oversize material from the first section of the lower deck may pass through the gap to be received in a first collection region, wherein at least one diverter member is provided between the upper and lower decks and located over the gap between the first and second sections of the lower deck whereby material from the upper deck collected on the at least one diverter member is passed onto the second section of the lower deck thereby preventing undersize material passing through the upper deck from passing directly through the gap.

Optionally the at least one diverter member has a downward slope towards the second section of the lower deck.

Optionally the vibration generating means is arranged to impart a resultant movement to material upon each deck from an upstream to a downstream end thereof. Additionally, or alternatively, each deck may have a downward slope from its upstream to its downstream end.

The fourth size of the grading apertures in the second section of the lower deck may be substantially equal to the first size of the grading apertures in the first section of the upper deck.

The first collection region may be arranged to receive undersize material from the second section of the lower deck as well as oversize material from the first section of the lower deck via the gap between the first and second sections of the lower deck.

A second collection region may be provided for receiving undersize material from the first section of the lower deck.

A third collection region may be provided for receiving oversize material from the second section of the upper deck and a fourth collection region may be provided for receiving oversize material from the second section of the lower deck, whereby the first, second, third and fourth collection regions each receive a separate size grade of product.

The at least one diverter member may comprise a trough mounted beneath a portion of the upper deck located above the gap between the first and second sections of the lower deck, the trough receiving undersize material from the portion of the upper deck and having an open end for delivering the material onto the second section of the lower deck. Optionally the trough is mounted on the upper deck. For example, the trough may extend transversely across the width of the upper deck.

In one embodiment the upper deck includes a plurality of mat sections supported upon axially extending mat support members, the grading apertures being formed in the mat sections, the at least one diverter member comprises a plurality of trough sections, each trough section being mounted on and extending between respective adjacent pairs of the axially extending mat support members such that the trough sections are located beneath the mat sections located over the gap between the first and second sections of the lower deck, each trough section having an open downstream end adapted to deliver material onto the second section of the lower deck.

This arrangement enables a twin deck screen to produce four different size grades of product and allows a greater area for finer screening that prior art arrangements.

Typically screening finer fractions is more difficult, requiring more area for a defined tonnage than courser fractions.

These and other objects, advantages and features of the invention will become apparent upon review of the following specification in conjunction with the drawings.

BRIEF DESCRIPTION OF THE DRAWINGS

A screening assembly in accordance with an embodiment of the present invention will now be described, by way of example only, with reference to the accompanying drawings, in which:—

DETAILED DESCRIPTION OF THE PREFERRED EMBODIMENTS

Figure 1:
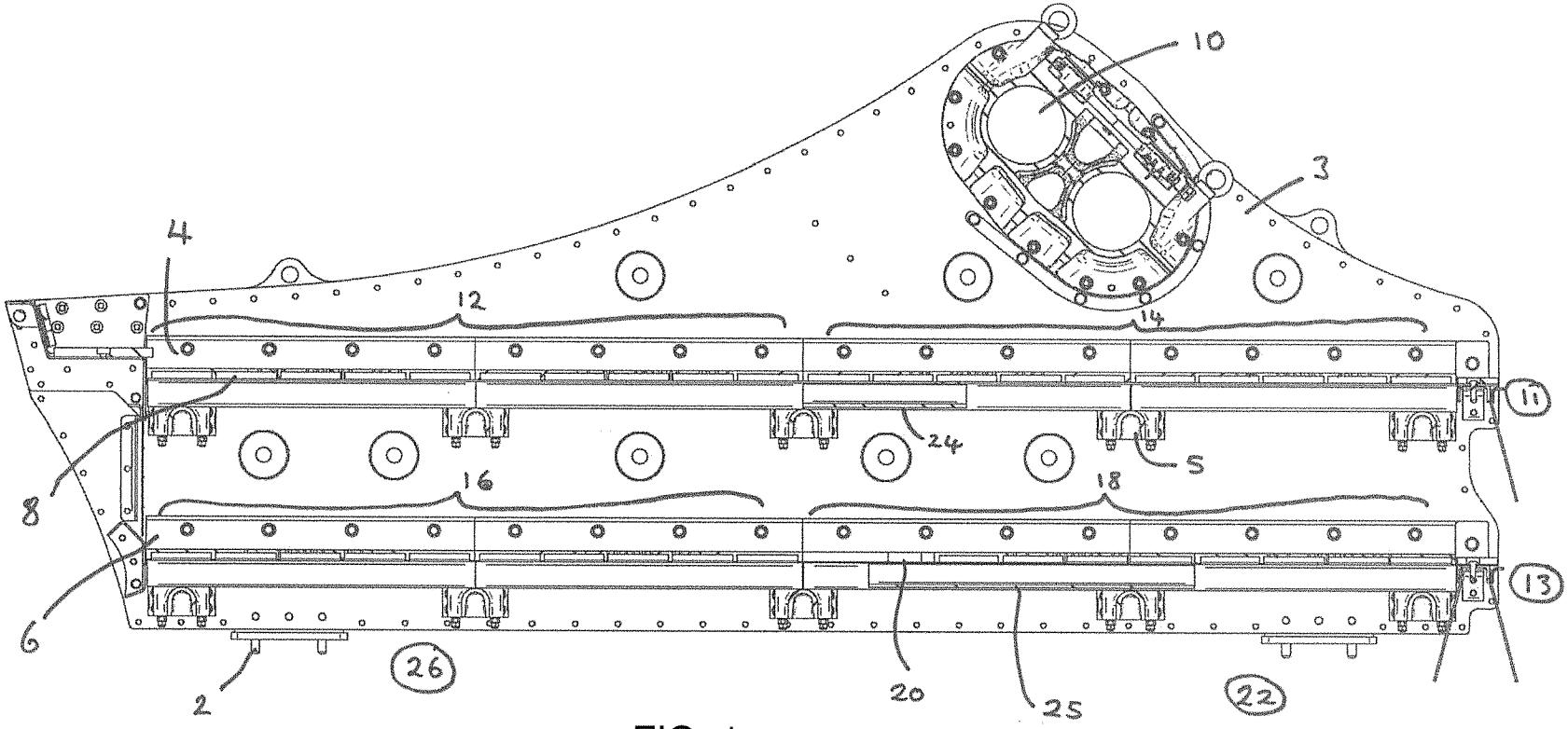
FIG. 1 is a side view of a screening apparatus in accordance with an embodiment of the present invention.
Figure 2:
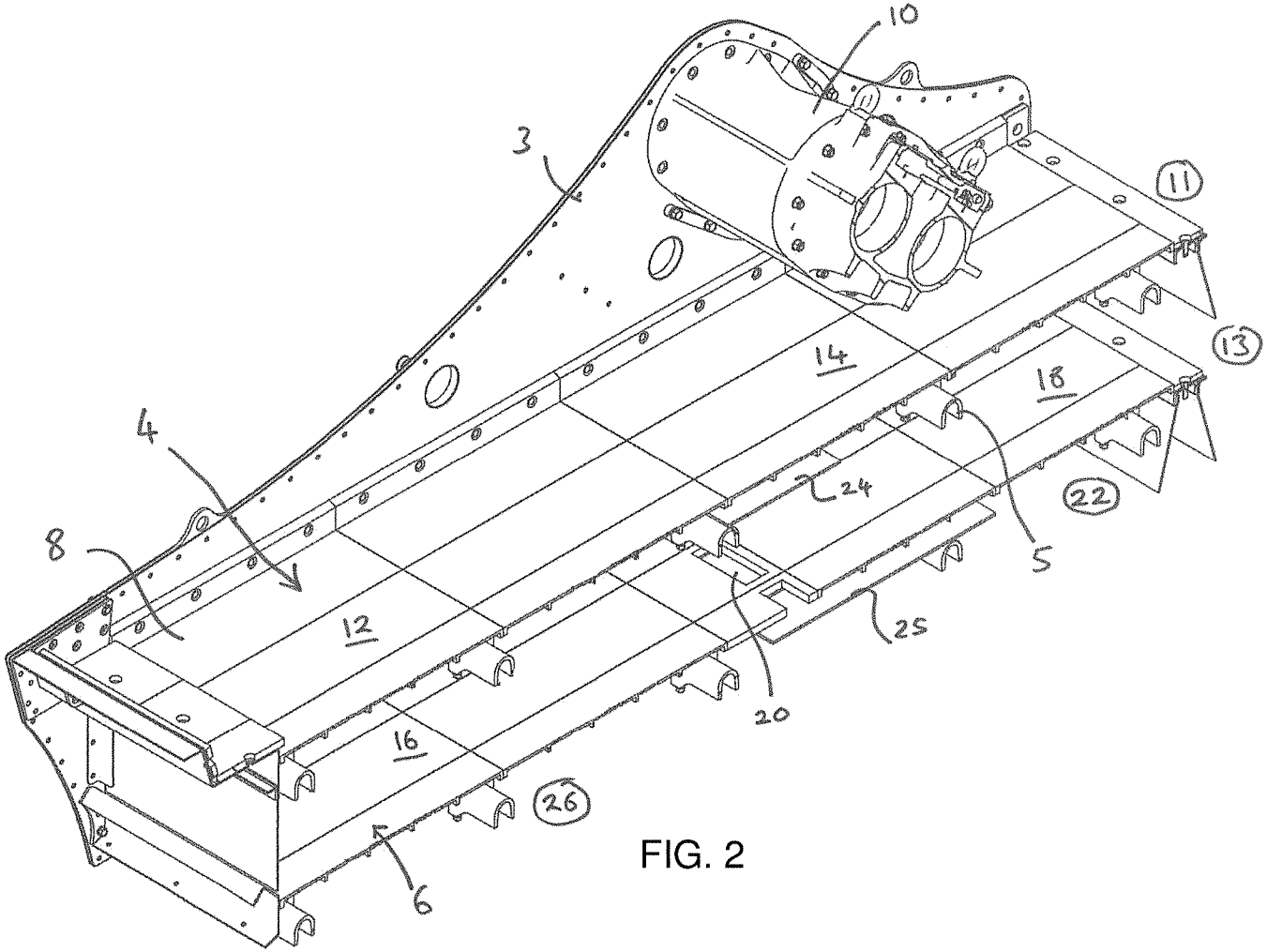
FIG. 2 is a sectional perspective view of the apparatus of FIG. 1.
Figure 3:
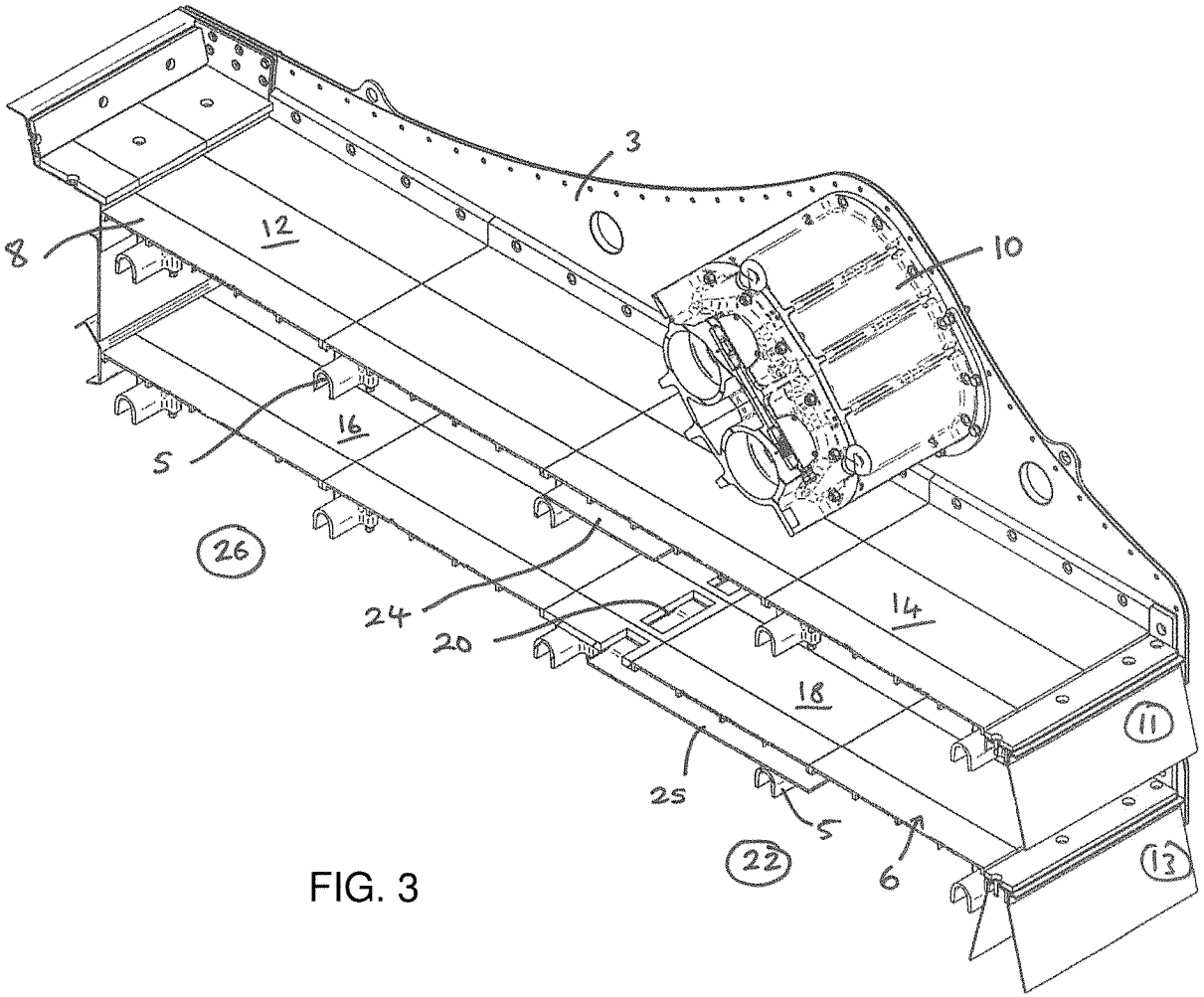
FIG. 3 is a further sectional perspective view of the apparatus of FIG. 1.

A multi-deck screening assembly in accordance with the present invention is illustrated in the drawings. The screening assembly comprises an elongate chassis 2 having mounted thereon a twin deck grading screen comprising substantially parallel upper 4 and lower 6 decks having grading apertures formed therein mounted on a frame defined by a pair of substantially parallel side walls 3 interconnected by transversely extending bridging members 5. Each of the upper and lower screen decks 4,6 comprise polyurethane mats 8 having small openings or slots for water and/or undersize particles to pass through, the mats being supported on axially extending support rods 9, as is known in the art.

The grading screen is mounted on the chassis 2 via resilient mountings and a vibration generating means 10, in the form of a pair of eccentrically mounted motor driven rotors, is mounted between the side members of the screen for imparting circular or reciprocating vibratory motion to the decks 4,6 of the grading screen. Optionally two counter rotating rotors are mounted aligned with an inclined plane to impart a resultant motion on material from an upstream to a downstream end of each deck. Additionally, or alternatively, each deck may be inclined downwardly from its upstream to its downstream end.

Material is supplied onto an upstream end of the upper deck and material of a size in excess of the size of the screening apertures of each screen deck is discharged under gravity action from the downstream end of the respective deck into a respective collection region 11,13, whereas under-sized material passes downwardly through the screening apertures of the respective screen deck 4,6 under gravity.

The upper deck 4 is divided into two sections, an upstream section 12, occupying approximately half of the area of the upper deck 4, comprising mats having a first aperture size, for example 8 mm, and a downstream section 14 comprising mats having a second aperture size, for example 16 mm.

The lower deck 6 is also divided into two sections, an upstream section 16, preferably occupying approximately 60% of the area of the lower deck 6, having a third aperture size for screening fine material, for example 4 mm, and a downstream section 18 having a fourth aperture size, preferably substantially equal to that of the upstream section of the upper deck (for example 8 mm). A transversely extending gap 20 is provided between the upstream and downstream sections 16,18 of the lower deck 6 whereby oversize material passing over the upstream section 16 of the lower deck can pass through the gap 20 to be received in a collection region 22. This collection region 22 also receives undersize material from the downstream section 18 of the lower deck 6.

To prevent undersize material from the downstream section 14 of the upper deck 4 from passing directly through the gap 20 between the upstream and downstream sections 16,18 of the lower deck 6, a diverter member 24 is located beneath the upper deck 4 in vertical alignment with the gap 20 between the upstream and downstream sections 16,18 of the lower deck 6. This diverter member 24 may be defined by tray or trough sections mounted on the upper deck 4 beneath the respective mats 8 located over the gap 20 in the lower deck 6.

The diverter member 24 collects undersize material falling through the mats 8 of the upper deck 4 directly thereabove and discharges such material onto the downstream section 18 of the lower deck 6, thus avoiding excess sized material from entering the collection region via the gap 20.

A further diverter member 25 may be used below the gap 20 and a portion of the downstream section 18 of the lower deck to transfer material to the collection region 22.

In one embodiment, in use, material to be graded having a size range between 1 mm and 32 mm may be fed onto the grading screen, being delivered onto the upstream section 12 of the upper deck 4, wherein water is added to the material and undersize material having a diameter less than the 8 mm aperture size of the grading apertures in the upstream section 12 of the upper deck 4, passes through the upper deck 4 to be delivered onto the upstream section 16 of the lower deck 6 under gravity, while material having a diameter greater than 8 mm passes onto the downstream section 14 of the upper deck 4. The downstream section 14, having an aperture size of 16 mm, allows material between 8 mm and 16 mm to fall onto the downstream section 18 of the lower deck 4, some via the diverter member 24.

Material having a size between 16 mm and 32 mm passes over the downstream end of the upper deck 4 to be collected in the collection region 11 and typically conveyed onto a stockpile by a suitable conveyor as a first product.

Material between 8 mm and 16 mm passes over the downstream section 18 of the lower deck 6 to be collected in the collection region 13 as a second product, which may be conveyed onto a further stockpile.

Material delivered onto the upstream section 16 of the lower deck 6, having passed through the grading apertures in the upstream section 12 of the upper deck 4, is graded on grading apertures of 4 mm, material larger than 4 mm (and less than 8 mm) passing over the upstream section 12 of the lower deck 6 to pass through the gap 20 between the upstream and downstream sections of the lower deck 6 to be collected in the collection region 22 along with material passing through the 8 mm diameter grading apertures of the downstream section 18 of the lower deck 6 to define a third product having a particle size between 4 mm and 8 mm.

Finally, material having a particle size less than 4 mm passes through the grading apertures in the upstream section 16 of the lower deck 6 to be collected in a respective collection region 26 therebelow as a fourth product.

The dimensions referred to above are merely illustrative and it is envisaged other grading aperture dimensions may be used depending upon the desired size range of each grade of material to be produced.

The invention is not limited to the embodiment(s) described herein, but can be amended or modified without departing from the scope of the present invention, which is intended to be limited only by the scope of the appended claims as interpreted according to the principles of patent law including the doctrine of equivalents.

The invention claimed is:

1. A multi-deck screening assembly comprising a plurality of vertically stacked screen decks, each screen deck having a plurality of grading apertures formed therethrough whereby under-sized material may pass through the apertures while over-sized material passes over a discharge end of each screen deck, the plurality of screen decks being mounted on a common frame, the frame being mounted on a chassis via resilient mounts and being provided with vibration generating means for imparting vibration to the screen decks, the plurality of screen decks comprising an upper deck and a lower deck mounted below the upper deck for receiving under-sized material from the upper deck, wherein the upper deck comprises a first deck section having grading apertures of a first size and a second deck section downstream of the first deck section, the second deck section having grading apertures of a second size, the second size being larger than the first size, and wherein the lower deck comprises a first deck section having grading apertures of a third size and a second deck section, downstream of the first deck section of the lower deck, the second deck section of the lower deck having grading apertures of a fourth size, the fourth size being larger than the third size, a gap being defined between the first and second deck sections of the lower deck whereby oversize material from the first section of the lower deck may pass through the gap to be received in a first collection region, wherein at least one diverter member is provided between the upper and lower decks and located over the gap between the first and second sections of the lower deck, whereby material from the upper deck collected on the diverter member is passed onto the second section of the lower deck thereby preventing undersize material passing through the upper deck from passing directly through the gap, wherein the at least one diverter member comprises a trough mounted beneath a portion of the upper deck located above the gap between the first and second sections of the lower deck, the trough receiving undersize material from the portion of the upper deck and having an open end for delivering the material onto the second section of the lower deck.

2. The screening assembly of claim 1, wherein the fourth size is substantially equal to the first size.

3. The screening assembly of claim 1, wherein the at least one diverter member has a downward slope towards the second section of the lower deck.

4. The screening assembly of claim 1, wherein the first collection region is arranged to receive undersize material from the second section of the lower deck as well as oversize material from the first section of the lower deck via the gap between the first and second sections of the lower deck.

5. The screening assembly of claim 1, wherein a second collection region is provided for receiving undersize material from the first section of the lower deck.

6. The screening assembly of claim 5, wherein a third collection region is provided for receiving oversize material from the second section of the upper deck and a fourth collection region is provided for receiving oversize material from the second section of the lower deck, whereby the first, second, third and fourth collection regions each receive a separate size grade of product.

7. The screening assembly of claim 1, wherein the trough is mounted on the upper deck.

8. The screening assembly of claim 1, wherein the trough extends transversely across the width of the upper deck.

9. A multi-deck screening assembly comprising a plurality of vertically stacked screen decks, each screen deck having a plurality of grading apertures formed therethrough whereby under-sized material may pass through the apertures while over-sized material passes over a discharge end of each screen deck, the plurality of screen decks being mounted on a common frame, the frame being mounted on a chassis via resilient mounts and being provided with vibration generating means for imparting vibration to the screen decks, the plurality of screen decks comprising an upper deck and a lower deck mounted below the upper deck for receiving under-sized material from the upper deck, wherein the upper deck comprises a first deck section having grading apertures of a first size and a second deck section downstream of the first deck section, the second deck section having grading apertures of a second size, the second size being larger than the first size, and wherein the lower deck comprises a first deck section having grading apertures of a third size and a second deck section, downstream of the first deck section of the lower deck, the second deck section of the lower deck having grading apertures of a fourth size, the fourth size being larger than the third size, a gap being defined between the first and second deck sections of the lower deck whereby oversize material from the first section of the lower deck may pass through the gap to be received in a first collection region, wherein at least one diverter member is provided between the upper and lower decks and located over the gap between the first and second sections of the lower deck, whereby material from the upper deck collected on the diverter member is passed onto the second section of the lower deck thereby preventing undersize material passing through the upper deck from passing directly through the gap, wherein the upper deck includes a plurality of mat sections supported upon axially extending mat support members, the grading apertures being formed in the mat sections, the at least one diverter member comprises a plurality of trough sections, each trough section being mounted on and extending between respective adjacent pairs of the axially extending mat support members such that the trough sections are located beneath the mat sections located over the gap between the first and second sections of the lower deck, each trough section having an open downstream end adapted to deliver material onto the second section of the lower deck.

10. The screening assembly of claim 9, wherein the fourth size is substantially equal to the first size.

11. The screening assembly of claim 9, wherein the at least one diverter member has a downward slope towards the second section of the lower deck.

12. The screening assembly of claim 9, wherein the first collection region is arranged to receive undersize material from the second section of the lower deck as well as oversize material from the first section of the lower deck via the gap between the first and second sections of the lower deck.

13. The screening assembly of claim 9, wherein a second collection region is provided for receiving undersize material from the first section of the lower deck.

14. The screening assembly of claim 13, wherein a third collection region is provided for receiving oversize material from the second section of the upper deck and a fourth collection region is provided for receiving oversize material from the second section of the lower deck, whereby the first, second, third and fourth collection regions each receive a separate size grade of product.

15. The screening assembly of claim 9, wherein at least one of the trough sections is mounted on the upper deck.

16. The screening assembly of claim 9, wherein at least one of the trough sections extends transversely across the width of the upper deck.

* * * * *